United States Patent [19]

Kawarabashi

[11] Patent Number: 4,930,301

[45] Date of Patent: Jun. 5, 1990

[54] DEVICE FOR CATCHING YARN UPON YARN BREAK IN TWO-FOR-ONE TWISTER

[75] Inventor: Tsukasa Kawarabashi, Kyoto, Japan

[73] Assignee: Murata Kikai Kabushiki Kaisha, Kyoto, Japan

[21] Appl. No.: 276,788

[22] Filed: Nov. 28, 1988

[30] Foreign Application Priority Data

Nov. 30, 1987 [JP] Japan ..... 62-182143[U]

[51] Int. Cl.[5] ..... D01H 7/86; D01H 13/14

[52] U.S. Cl. ..... 57/80; 57/58.83; 57/353

[58] Field of Search ..... 57/58.49, 58.83, 80, 57/83, 81, 352, 353

[56] References Cited

U.S. PATENT DOCUMENTS

| | | | |
|---|---|---|---|
| 2,840,979 | 7/1958 | Harmon | 57/80 X |
| 3,857,228 | 12/1974 | Nakahara et al. | 57/80 X |
| 3,995,418 | 12/1976 | Neyraud | 57/80 |
| 4,091,604 | 5/1978 | Greive | 57/80 |
| 4,574,575 | 3/1986 | Franzen | 57/80 |
| 4,787,199 | 11/1988 | Schaub | 57/80 |

FOREIGN PATENT DOCUMENTS

| | | | |
|---|---|---|---|
| 1174660 | 7/1964 | Fed. Rep. of Germany | 57/81 |

*Primary Examiner*—Joseph J. Hail, III

*Attorney, Agent, or Firm*—Spensley Horn Jubas & Lubitz

[57] ABSTRACT

A device for catching a yarn upon yarn break in a two-for-one twister, comprising a drop wire which moves down upon break of a yarn, and a contacting member secured to the drop wire and adapted to be contacted with an upper end portion of a tenser cap.

5 Claims, 4 Drawing Sheets

DEVICE FOR CATCHING YARN UPON YARN BREAK IN TWO-FOR-ONE TWISTER

FIELD OF THE INVENTION

The present invention relates to a two-for-one twister, and more particularly to a device for catching a yarn connecting to a yarn supply package upon break of the yarn.

RELATED ART STATEMENT

In a known two-for-one twister, a yarn released from a yarn supply package passes through a hollow spindle and goes out from and ballooned by a yarn guide of a yarn reserving disk whereafter it is guided to a balloon guide located just above a two-for-one yarn twisting spindle. In case a yarn is broken, for example, during ballooning in such a two-for-one twister, the yarn near the yarn reserving disk at a broken end of the yarn on the side connecting to the yarn supply package is drawn out radially outwardly by a centrifugal force caused by rotation of the yarn reserving disk, and the thus drawn out yarn will be wrapped several times around an outer periphery of the yarn reserving disk.

Conventionally, in order to prevent such a wrapping accident as described above, such measures are known that a drop wire which drops only upon break of a yarn is provided, and a yarn released from a yarn supply package is caught at a position directly before it enters a tenser by a yarn catching means provided at an end of the wire.

However, even if the conventional device described above is used, the yarn is sometimes drawn out after break of the yarn. Examination of a cause of it revealed that there is a fluctuation in amount of a drawn out yarn depending upon the position at which the yarn is broken such that if the broken position is just in front of the dropping position of the drop wire, then the amount of the drawn out yarn is small, but if the broken position is just behind the dropping position of the drop wire, then a large amount of the yarn corresponding to about 360 degrees (one complete circumference of a yarn supply package) is drawn out. Particularly, as in recent years the speed of rotation of a spindle is raised and the size of a yarn supply package is increased (naturally the diameter of the same is increased), the amount of yarn being drawn out is increased, and winding of the yarn around a spindle or wrapping of the yarn around some other members (or some other spindles) makes a problem.

OBJECT AND SUMMARY OF THE INVENTION

It is an object of the present invention to propose a device wherein release of a yarn from a yarn supply package can be stopped directly just after the yarn has been broken.

The present invention provides a device for catching a yarn upon yarn break in a two-for-one twister, which is constituted such that it comprises a drop wire which moves down upon break of a yarn, and a contacting member secured to the drop wire and adapted to be contacted with an upper end portion of a tenser cap when the drop wire moves down.

When a yarn is broken, the drop wire moves down so that the contacting member and the upper end portion of the tenser cap are contacted with each other and the yarn is caught between them.

DETAILED DESCRIPTION OF PREFERRED EMBODIMENTS

Figure 5:
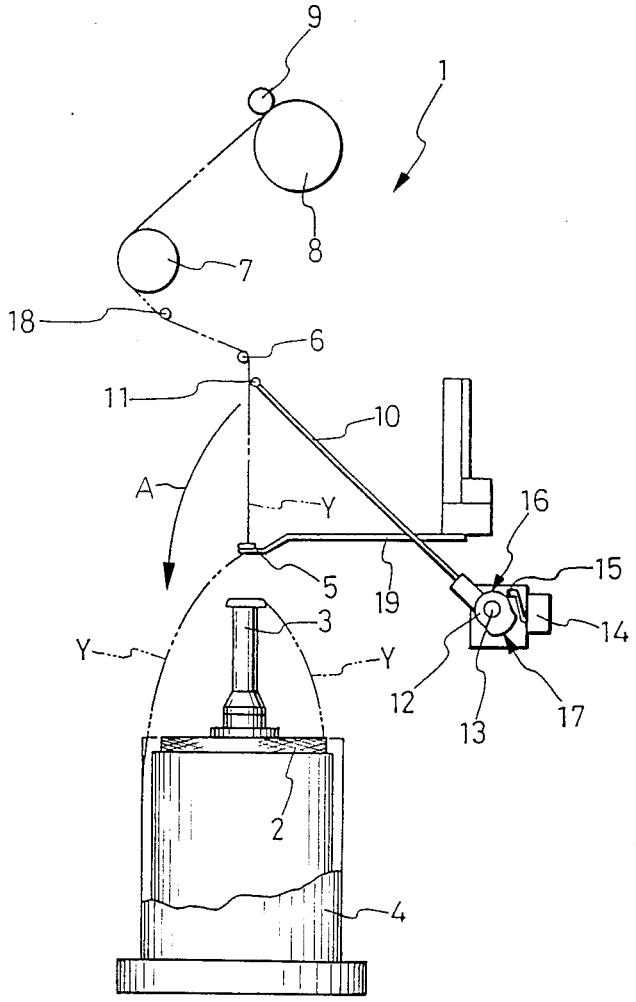

In FIG. 5, general construction of one of units of a two-for-one twister is shown. At the unit 1, a yarn Y drawn out from a yarn supply package 2 and passing through the inside of a tenser cap 3 passes through a hollow of a spindle body and then runs in the form of a balloon in the inside of a balloon control ring 4 so that twists are applied to the yarn Y. The yarn Y then passes through a balloon guide 5 and runs upwardly whereafter it passes a yarn guide 6, a movable guide 18 and a feed roller 7 and then it is wound onto a take-up tube 9 to which a rotating force is applied by a drum 8. Reference numeral 10 denotes a drop wire, and the drop wire 10 has a yarn arresting member 11 provided in an integral relationship at an end thereof. The drop wire 10 is securely mounted at a base end thereof to a cam plate 12 which is securely mounted on a shaft 13. The cam plate 12 has a smaller diameter portion 16 and a greater diameter portion 17 such that a contact element 15 of a limit switch 14 may be displaced depending upon a yarn arresting position of the drop wire 10 indicated by a solid line and a dropping position of the drop wire 10 indicated by an arrow A.

Figure 1:
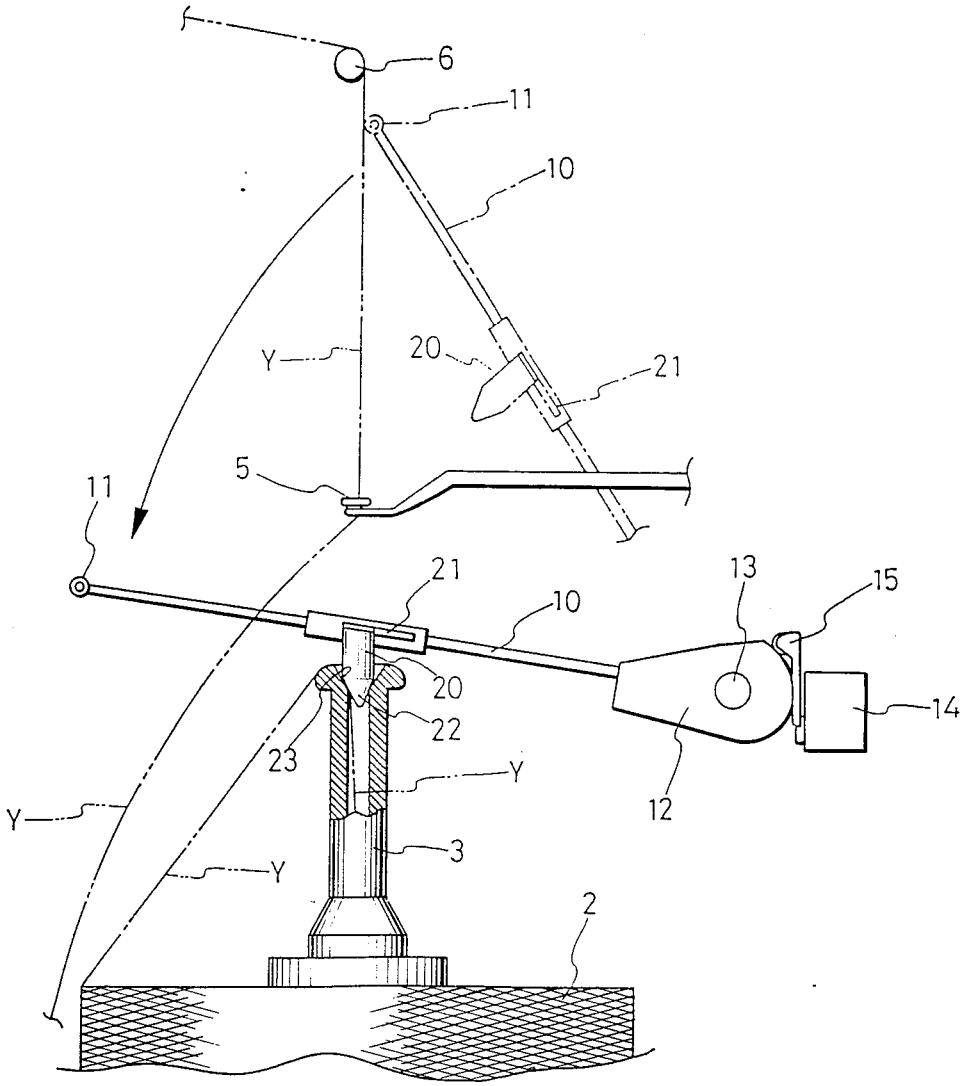
FIG. 1 is a front elevational view, partly broken, showing a yarn catching device according to the present invention, FIG. 2 a plan view of the same when a drop wire drops, FIG. 3 a plan view of the same when a yarn is running, FIG. 4 a front elevational view, partly broken, showing another embodiment of the present invention, and FIG. 5 a front elevational view showing an example of two-for-one twister to which the present invention is applied.
Figure 2:
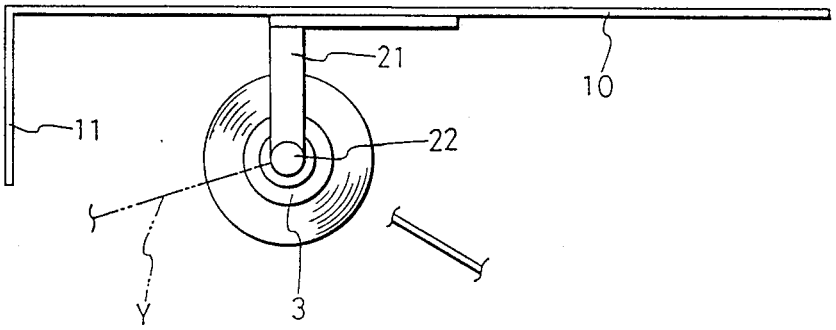
Figure 3:
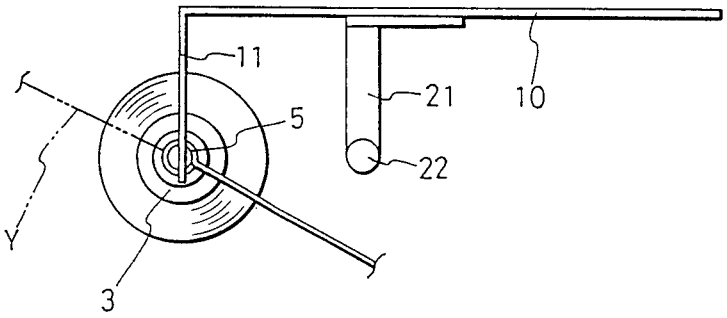

A contacting member 20 shown in FIGS. 1 to 3 is secured to an intermediate portion of the drop wire 10. The contacting member 20 is composed of a member having a high coefficient of friction such as rubber and is secured to the drop wire 10 by means of an L-shaped bracket 21. A lower end 22 of the contacting member 20 is tapered into a conical configuration. Further, when the drop wire 10 drops, the end 22 of the contacting member 20 can be inserted into a hole 23 of a hollow portion of the tenser cap 3. The hole 23 is tapered such that it may be opened outwardly toward the upper end thereof, and in cooperation with the tapered configuration of the end 22 of the contacting member, the hole 23 facilitates insertion of the contacting member 20 into the hole 23 and at the same time makes contact between them close.

Now, if a yarn being ballooned is broken by some causes, the tension of the running yarn is reduced to zero by such break so that the drop wire 10 drops. As a result of such dropping, the contacting member 20 is fitted into the hole 23 of the tenser cap 3 so that the yarn Y is caught by and between the tenser cap 3 and the tapered face at the end 22 of the contacting member 20 thereby to stop the yarn from being drawn out further from the yarn supply package 2. It is to be noted that the positions of the drop wire 10 and the contacting member 20 when the yarn is running are shown in FIG. 3 while the positions of them when the yarn is broken are shown in FIG. 2, and the contacting member 20 moves in a position where it will not interfere with the balloon guide 5.

Figure 4:
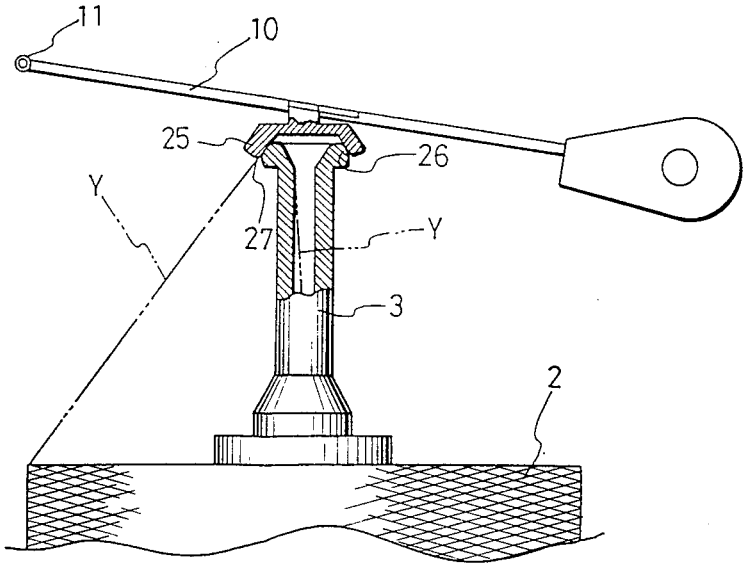

In FIG. 4, a second embodiment of the present invention is shown. In the present embodiment, a contacting member 35 has such a configuration that it covers over an upper end portion of a tenser cap 3, and when a drop wire 10 moves down, an inner circumferential face 26 of the contacting member 25 and an outer circumferential face 27 at an upper end of the tenser cap 3 are contacted with each other so that a yarn Y is caught between them. It is to be noted that like members to those of the first embodiment are denoted by like reference numerals and description thereof is omitted herein.

As apparent from the foregoing description, according to the present invention, release of a yarn from a yarn supply package can be stopped directly after the yarn has been broken irrespective of the position at which the yarn is released from the yarn supply package upon break of the yarn. Accordingly, no yarn is drawn out radially outwardly by a centrifugal force after break of the yarn, and a trouble caused by the thus drawn out yarn is eliminated.

What is claimed is:

1. A device for catching yarn upon a break in the yarn in a two-for-one twister, comprising:

a tenser cap including an end portion having a substantially continuous peripheral surface defining the outer circumference of a hole in the tenser cap through which the yarn passes, a drop wire operable for moving toward the tenser cap upon a break in the yarn, and a contacting member secured to the drop wire and having a conically tapered lower end defining a substantially continuous peripheral surface, the peripheral surface of the contacting member being adapted for insertion into the hole of the tenser cap when the drop wire moves towards the tenser cap to contact substantially all of the peripheral surface of the end portion of the tenser cap when the drop wire moves toward the tenser cap, whereby the yarn is positively caught between the contacting member and the end portion of the tenser cap when the drop wire moves toward the tenser cap.

2. The device for catching yarn as claimed in claim 1, wherein the contacting member is made of material having a high coefficient of friction.

3. The device for catching yarn as claimed in claim 1, wherein the contacting member is made of resilient material.

4. The device for catching yarn as claimed in claim 3 wherein the contacting member is made of rubber.

5. The device for catching yarn as claimed in claim 1, wherein the peripheral surface of the contacting member is adapted to cover the peripheral surface of the end portion of the tenser cap when the drop wire moves toward the tenser cap.

* * * * *